US005135374A

United States Patent [19]

Yoshimura et al.

[11] Patent Number: 5,135,374

[45] Date of Patent: Aug. 4, 1992

[54] OIL FLOODED SCREW COMPRESSOR WITH THRUST COMPENSATION CONTROL

[75] Inventors: Shoji Yoshimura; Tetsuya Kakiuchi, both of Kakogawa, Japan

[73] Assignee: Kabushiki Kaisha Kobe Seiko Sho, Kobe, Japan

[21] Appl. No.: 668,165

[22] Filed: Mar. 12, 1991

[30] Foreign Application Priority Data

Jun. 30, 1990 [JP] Japan ..... 2-174205

[51] Int. Cl.[5] ..... F04C 18/16; F04C 29/10

[52] U.S. Cl. ..... 418/201.2; 418/203

[58] Field of Search ..... 418/2, 201.1, 201.2, 418/203

[56] References Cited

U.S. PATENT DOCUMENTS

| | | | |
|---|---|---|---|
| 3,314,597 | 4/1967 | Schibbye | 418/203 |
| 3,432,089 | 3/1969 | Schibbye . | |
| 3,811,805 | 5/1974 | Moody, Jr. et al. | 418/203 |
| 4,119,392 | 10/1978 | Breckheimer | 418/201.1 |
| 4,519,748 | 5/1985 | Murphy et al. | 418/201.2 |
| 4,609,329 | 9/1986 | Pillis et al. | 418/201.2 |
| 4,909,716 | 3/1990 | Orosz et al. | 418/201.2 |
| 4,964,790 | 10/1990 | Scott | 418/201.2 |

FOREIGN PATENT DOCUMENTS

| | | | |
|---|---|---|---|
| 58-51290 | 3/1983 | Japan | 418/203 |
| 1334304 | 10/1973 | United Kingdom | 418/203 |
| 8903482 | 4/1989 | World Int. Prop. O. . | |

*Primary Examiner*—Richard A. Bertsch
*Assistant Examiner*—David L. Cavanaugh
*Attorney, Agent, or Firm*—Oblon, Spivak, McClelland, Maier & Neustadt

[57] ABSTRACT

An oil flooded screw compressor wherein a thrust force acting upon a bearing is controlled within a fixed range to prevent possible damage to the bearing. The oil-cooled screw compressor comprises a pair of meshing screw rotors, a balance piston mounted for axial movement in parallel to axes of the screw rotors for causing, when operated, a force to act upon one of the screw rotors in a direction from the sucking side to the discharging side, and a slide valve for adjusting the volume of the screw compressor. A flow path of pressure fluid is provided for operating the balance piston and and is controlled such that it is opened when the slide valve is positioned on the full load side with respect to a preset position, but is closed when the slide valve is positioned at any other position.

5 Claims, 5 Drawing Sheets

OIL FLOODED SCREW COMPRESSOR WITH THRUST COMPENSATION CONTROL

BACKGROUND OF THE INVENTION

1. Field of the Invention

This invention relates to an oil-flooded screw compressor of the type which includes a balance piston for causing a force to act upon a screw rotor in a direction from the suction side to the discharge side, and a slide valve for adjusting the volume of the screw compressor.

2. Description of the Prior Art

Screw rotors of a screw compressor, particularly a male rotor, is acted upon, during compressing operation of the screw compressor, by a great thrust force in a direction from the discharge side to the suction side due to the structure of the screw compressor. Where such thrust force is excessively great, it will significantly reduce the life of thrust bearings by which the screw rotors are supported for rotation.

An oil-flooded screw compressor wherein a thrust force acting on a thrust bearing is reduced has been proposed and is disclosed, for example, in Japanese Utility Model Laid-Open No. 175592/1986. The thus disclosed oil-flooded screw compressor is shown in FIG. 6.

Referring to FIG. 6, the screw compressor includes a pair of female and male screw rotors 5 accommodated in a casing 3 and supported for rotation by means of a pair of bearings 4a and 4b. The casing 3 has a suction port 1 formed at an end thereof and has a discharge port 2 formed at the other end thereof. A balance piston 7 is provided at an end of a suction side rotor shaft 6 of one of the screw rotors 5 and fitted for sliding movement in a cylinder chamber 8 formed in the casing 3.

An oil separating and collecting device 32 is interposed in a discharging flow path 31 connecting to the discharging port 2, and an oil flow path 36 extends from an oil storage portion 33 at the bottom of the oil separating and collecting device 32. An oil cooler 34 and an oil pump 35 are interposed in the oil flow path 36, and the oil flow path 36 is branched into two paths and are communicated, on one hand, with lubricating portions of shaft seal parts, the bearings 4a and 4b and so forth by way of a flow path not shown and, on the other hand, with the cylinder chamber 8 by way of a pressure oil supplying port 9.

With the screw compressor, gas sucked into a gas compressing spacing in the inside of the casing 1 by way of the suction port 1 is compressed by the screw rotors 5 and discharged by way of the discharging port 2 together with oil for the cooling and so forth which has been inadvertently admitted into the gas compressing spacing. Then, the gas and oil thus discharged are introduced into the oil separating and collecting device 32 in which they are separated from each other. The compression gas from which the oil has been removed is sent out from an upper portion of the oil separating and collecting device 32. On the other hand, the oil drops into and is stored in the oil storage portion 33. Then, the oil is sent out from the oil storage portion 33 and then cooled by the oil cooler 34, whereafter it is fed to the lubricating portions and the end of the cylinder chamber 8 remote from the screw rotors 5. The oil admitted into the spacing around the screw rotors 5 is thereafter circulated along a similar route so that it may be used after then.

As oil of the oil flow path 36 is introduced to the end of the cylinder chamber 8 remote from the screw rotors 5 in this manner, a thrust force acting upon the screw rotors 5 from the discharge side to the suction side during operation of the screw compressor is reduced so that an excessive force may not be applied to the bearing 4b.

With the conventional oil-flooded screw compressor, the oil pressure at the end of the balance piston 7 remote from the screw rotors 5 is substantially equal to a discharge pressure Pd at the discharge port 2. However, if the other end of the balance piston 7 adjacent the screw rotors 5 is communicated directly with the suction port 1, then gas containing oil therein will flow from the cylinder chamber 8 to the sucking port 1, whereupon it is expanded, which will result in reduction of the amount of gas to be sucked into the rotor chamber by way of the sucking flow path. Therefore, the sucking port 1 is communicated with a gas enclosing spacing having an inner pressure a little higher than a suction pressure Ps which will appear where it is not communicated with the gas enclosing spacing, for example, a gas enclosing spacing having a pressure of 1.3Ps. Accordingly, a force F acting upon the balance piston 7 in a direction from the suction side to the discharge side is represented by the following expression, and during operation of the screw compressor, the magnitude of the force F is fixed when the discharge pressure Pd and the suction pressure Ps are fixed.

$$F = S \cdot (Pd - 1.3\ Ps)$$

where S represents an area of the pressure receiving portion of the balance piston 7. Here, a sectional area of the rotor side shaft 6 is ignored.

By the way, where the screw compressor is of the type which has a volume adjusting slide valve, the thrust force produced at the screw rotor 5 is reduced during partial load operation or no load operation of the screw compressor comparing with that during full load operation, and a force acting upon the balance piston 7 due to the oil pressure and another force acting upon the rotor shaft 6 from the screw rotors 5 sometimes become substantially equal to each other, which may put the bearing 4b into a condition wherein it undergoes so little thrust load that it may drift.

Referring to FIG. 7, the axis of abscissa indicates a slide valve position in a ratio (%) of the load in an operating condition at the position to the full load while the axis of ordinate indicates a force acting upon a thrust bearing. When the force acting upon the bearing 4b becomes excessively great until it exceeds a predetermined value $f_1$, the life of the bearing becomes shorter than a fixed reference interval of time, for example, 20,000 hours. Thus, while the force where the balance piston 7 is not provided is such as shown by an alternate long and two short dashes line curve I which exceeds the force $f_1$ when the slide valve comes to a position considerably near to its full load position (100%), according to the screw compressor described above in which the balance piston 7 is provided, the force acting upon the bearing 4b is reduced uniformly by a same magnitude over every position of the slide valve such that the highest value thereof may be smaller than the level $f_1$ as seen from another solid line curve II in FIG. 7.

However, if the force acting upon the bearing 4*b* is excessively small below another predetermined value $f_2$, then the bearing 4*b* may drift and be likely damaged. In particular, even if such balance piston 7 as described above is provided, a problem still remains that, if the slide valve approaches the no load operation position (0%) as seen from the curve II, the force acting upon the bearing 4*b* becomes smaller than the value $f_2$ and is liable to be damaged.

SUMMARY OF THE INVENTION

It is an object of the present invention to provide an oil-flooded screw compressor wherein a thrust force acting upon a bearing is controlled within a fixed range to prevent possible damage to the bearing.

In order to attain the object, according to the present invention, there is provided an oil-flooded screw compressor, which comprises a housing, a pair of meshing screw rotors accommodated for individual rotation in the housing, a balance piston mounted for axial movement in parallel to axes of the screw rotors for causing, when operated, a force to act upon one of the screw rotors in a direction from the suction side to the discharge side, a slide valve for adjusting the volume of the screw compressor, means defining a flow path of pressure fluid for operating the balance piston, means for detecting a position of the slide valve in the axial direction, and control means for controlling the flow path such that the flow path is opened when the slide valve is positioned on the full load side with respect to a preset position, but the flow path is closed when the slide valve is positioned at any other position.

With the oil-flooded screw compressor, bearings on which the screw rotors are supported are normally acted upon by thrust loads which range from a predetermined upper limit value to another predetermined lower limit value. In other words, the thrust force acting upon the bearings is kept to a magnitude between such allowable upper and lower limit values. Accordingly, a damage which may occur when the thrust loads are excessively great or excessively small is prevented effectively, and the durability of the bearing is improved.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
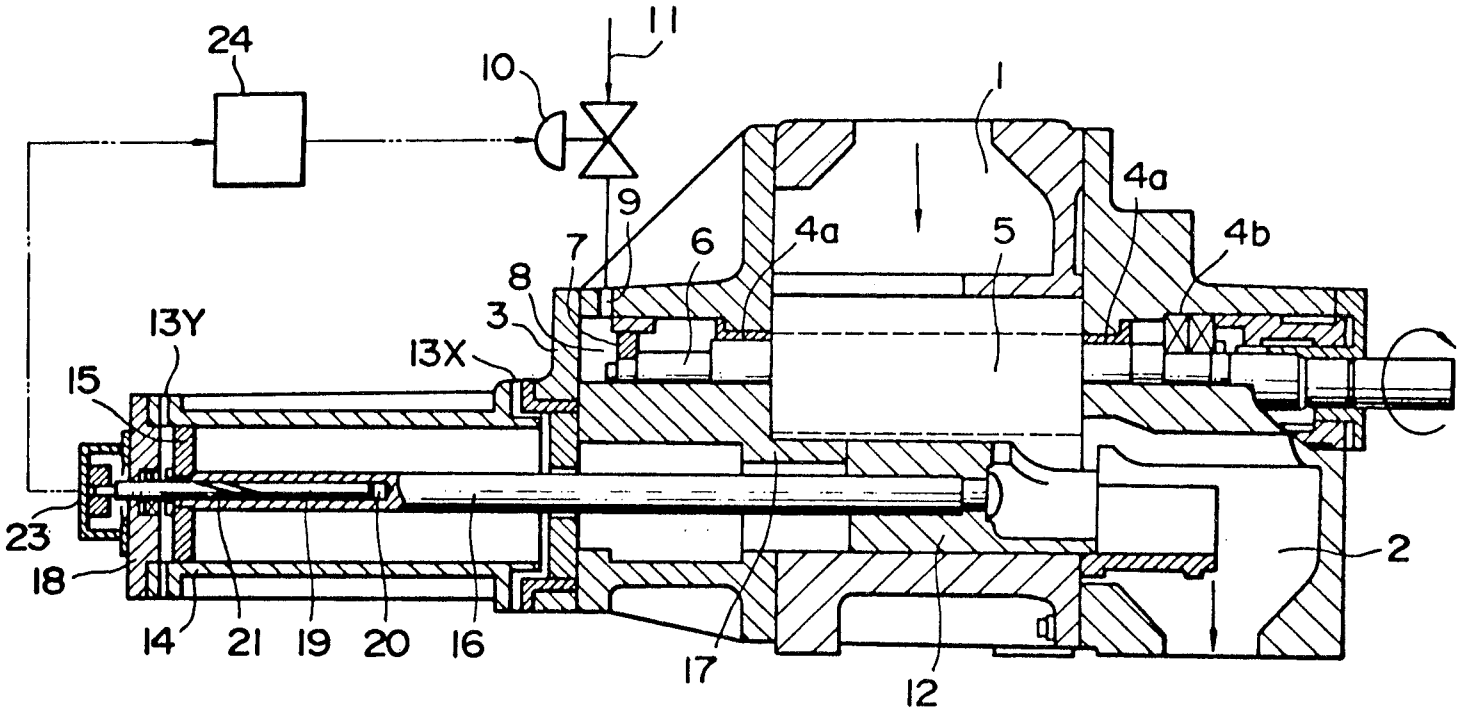
FIG. 1 is a partial sectional view of an oil-cooled screw compressor showing a first embodiment of the present invention.
Figure 6:
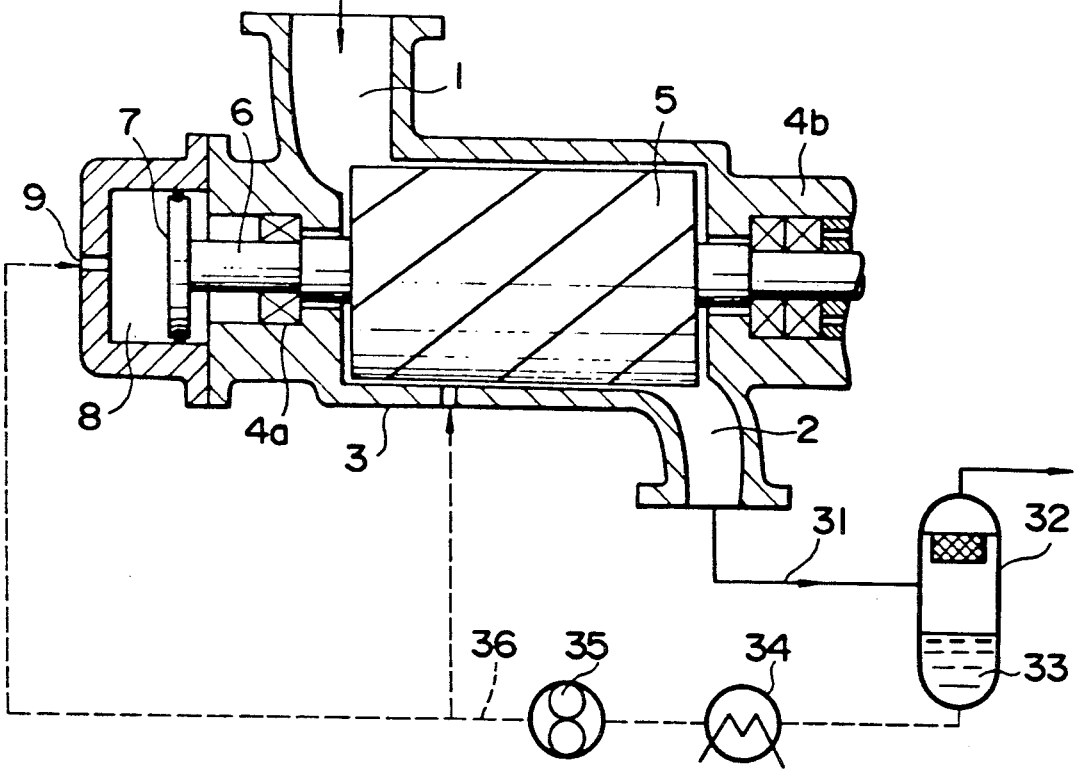
FIG. 6 PRIOR ART
FIG. 6 is a sectional view showing a conventional oil-cooled screw compressor.
Figure 7:
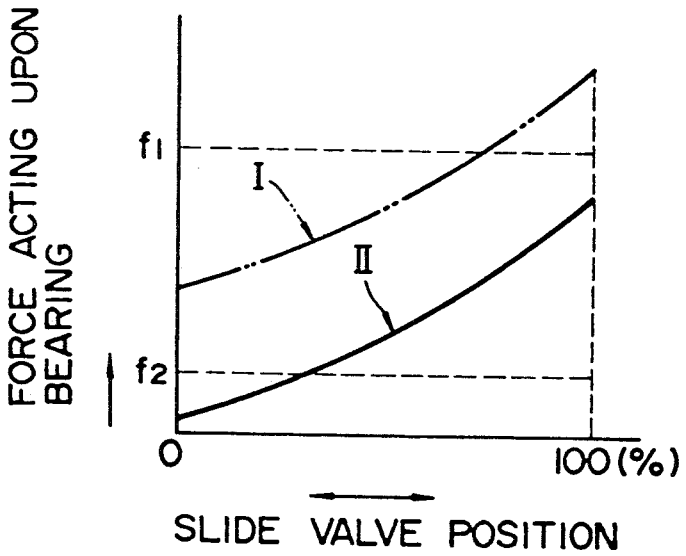
FIG. 7 is a graph illustrating a relationship between a slide valve position and a force acting upon a bearing in the screw compressor shown in FIG. 6.

Referring first to FIG. 1, there is shown an oil-flooded screw compressor according to a first embodiment of the present invention. The oil-flooded screw compressor includes, similarly to the conventional oil-flooded screw compressor shown in FIG. 6, a pair of mutually meshing female and male screw rotors 5 accommodated in a casing 3 and supported for rotation by two sets of bearings 4*a* and 4*b*. The casing 3 has suction port 1 formed at a side portion thereof and has a discharge port 2 formed at the other side portion thereof. A balance piston 7 is provided at an end of a suction side rotor shaft 6 and fitted for sliding movement in a cylinder chamber 8 formed in the casing 3. A pressure oil inlet port 9 is formed in a wall of the cylinder 8 adjacent an end remote from the screw rotors 5, and an oil path 11 is connected to the pressure oil inlet port 9. A two position electromagnetic opening/closing valve 10 is interposed in the oil path 11. The oil path 11 may be similar, for example, to the branch path of the oil flow path 36 extending from the oil pump 35 to the cylinder chamber 8 shown in FIG. 6. Accordingly, during operation of the screw compressor, a pressure substantially equal to a discharge pressure normally acts upon the inlet side of the opening/closing valve 10. A volume adjusting slide valve 12 is mounted for back and forth movement between the casing 3 and the rotor 5.

A cylinder 14 is secured to the casing 3 and has a pair of inlet/outlet ports 13X and 13Y for pressure oil formed therein. A piston 15 is fitted for sliding movement in the cylinder 14 and connected to the slide valve 12 by way of a piston rod 16 so that the slide valve 12 is moved back and forth between the rotor 5 and an inner wall of the casing 3 by the piston 15. A retracted position of the slide valve 12 is defined by a stopper 17 which forms part of the casing 3.

Figure 2:
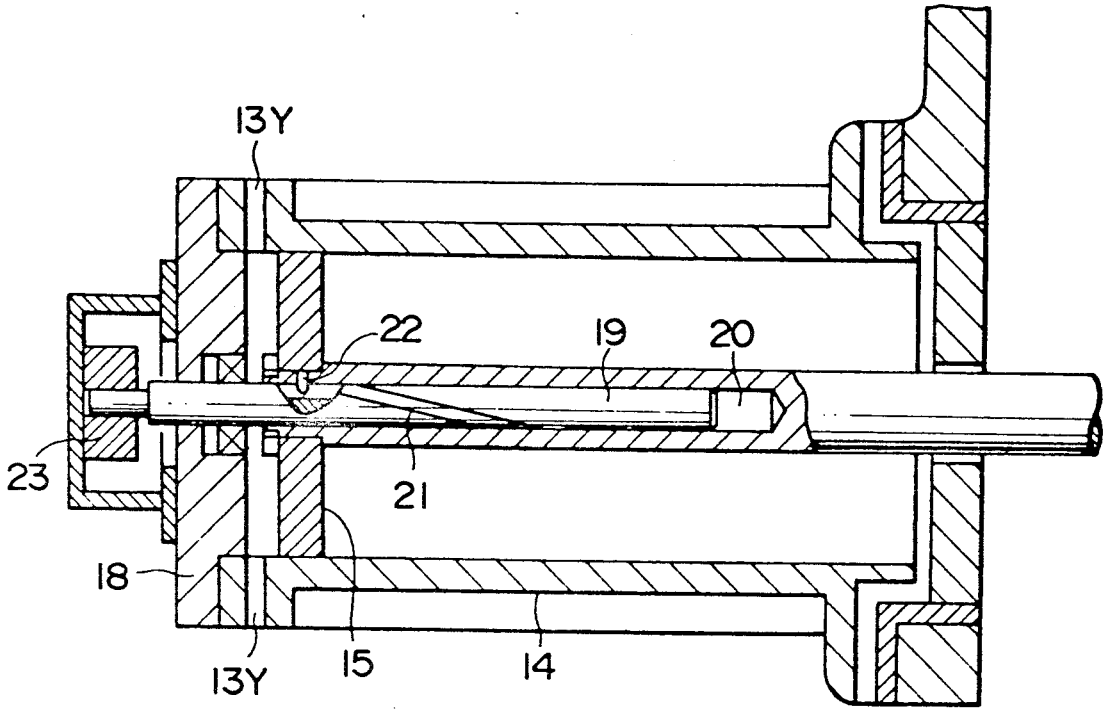
FIG. 2 is an enlarged sectional view of a slide valve driving section of the screw compressor shown in FIG. 1.

Referring also to FIG. 2, a rotary shaft 19 extends through an end plate 18 at an end of the cylinder 14 remote from the screw rotors 5 and is supported for rotation at a fixed position without moving in an axial direction. The rotary shaft 19 is fitted for relative rotation in a coaxial bore 20 formed at an end portion of the piston rod 16. A helical groove 21 is formed on the rotary shaft 19 while a pin 22 is secured to the piston rod 16 and extends inwardly into the hole 20 so that it is engaged for sliding movement in the helical groove 21. Rotational angle detecting means 23 is mounted at an end of the rotary shaft 19 remote from the screw rotors 5. When the piston rod 16 is axially advanced or retracted together with the piston 15, the rotary shaft 19 is acted upon by a force from the pin 22 held in engagement with the helical groove 21 so that it is rotated at the fixed position by an angle corresponding to the distance of advancing or retracting movement of the piston rod 16. An angle of such rotation of the rotary shaft 19 is detected by the rotational angle detecting means 23.

A detection value by such detection of the rotational angle detecting means 23 is inputted to controlling means 24. The controlling means 24 thus calculates a position of the slide valve 12 and outputs a control signal to the opening/closing valve 10 so that, when the position of the slide valve 12 is on the full load side with respect to a preset position $a_0$, the opening/closing valve 10 is opened, but in any other position of the slide valve 12, the opening/closing valve 10 is closed.

Figure 3:
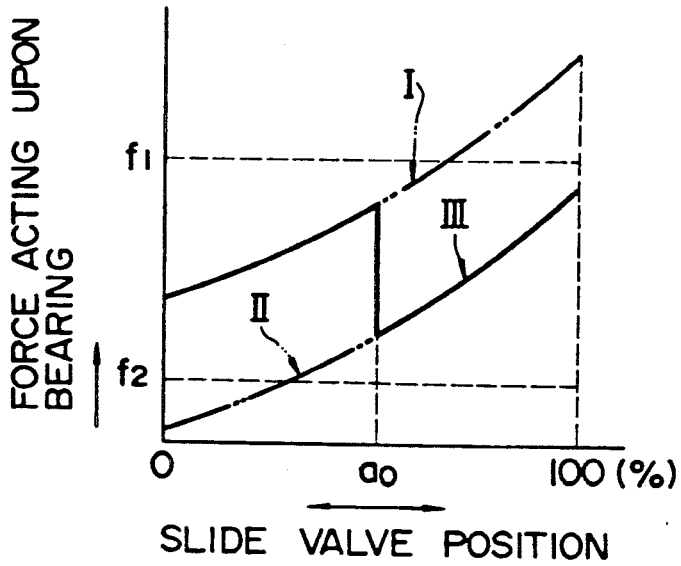
FIG. 3 is a graph illustrating a relationship between a slide valve position and a force acting upon a bearing in the screw compressor shown in FIG. 1.

As the opening/closing valve 10 is opened or closed in accordance with a position of the slide valve 12 in this manner, when the slide valve 12 is positioned on the full load side with respect to the preset position $a_0$ as seen from a solid line curve III in FIG. 3, the force acting upon the bearings 4b is reduced or partially offset by the force acting in a direction from the sucking side toward the discharging side from the balance piston 7 which receives a pressure substantially equal to the discharging pressure so that it becomes, even at the greatest, smaller than $f_1$. On the other hand, when the slide valve 12 is positioned on the no load side with respect to the preset position $a_0$, the force acting upon the bearings 4a and 4b from the screw rotors 5 is reduced. However, the action of the oil pressure at the end of the balance piston 7 remote from the screw rotors 5 is stopped so that the force acting upon the bearing 4b may be greater, even when it is at the smallest, than $f_2$. In particular, when the force acting upon the bearing 4b from the screw rotors 5 is reduced to a certain degree, the pressurization by the balance piston 7 is stopped so that the force acting upon the bearing 4b may normally be kept between the values $f_1$ and $f_2$.

Figure 4:
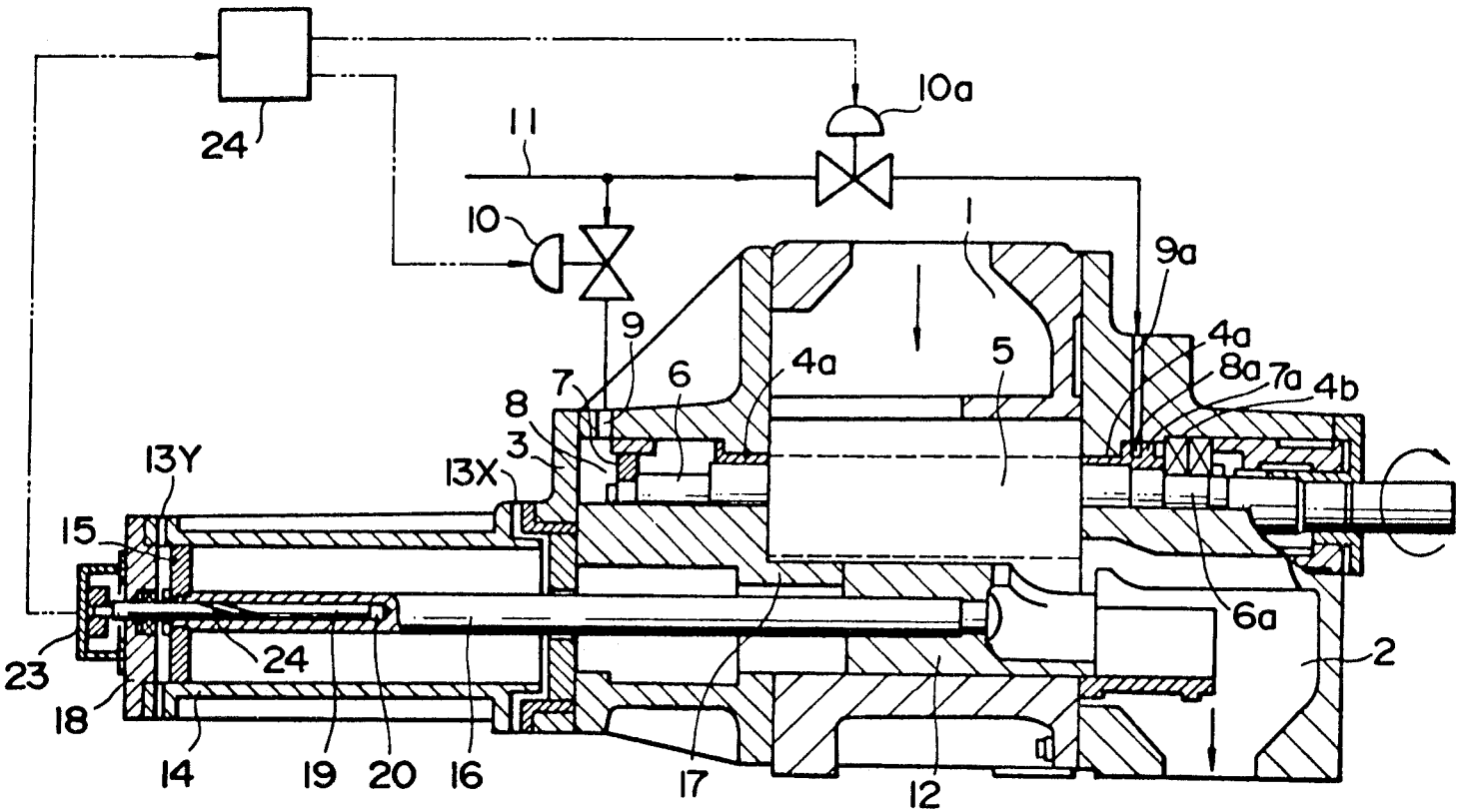
FIG. 4 is a sectional view of a modified oil-flooded screw compressor.

Referring now to FIG. 4, there is shown a modification to the oil-flooded screw compressor shown in FIGS. 1 and 2. The modified oil-flooded compressor is only different in that the force acting in a direction from the sucking side to the discharging side is changed at two times, that is, at two slide valve positions.

In particular, the modified oil-flooded screw compressor includes, in addition to such balance piston 7 as described hereinabove, another balance piston 7a for a discharging side rotor shaft 6a, and a pressure oil inlet/-outlet port 9a is formed in a casing 3 such that it communicates with a rotor side spacing of a cylinder chamber 8a. An oil path 11 is branched on the inlet side of an opening/closing valve 10 and connected to the pressure oil inlet/outlet port 9a by way of another electromagnetic opening/closing valve 10a.

Figure 5:
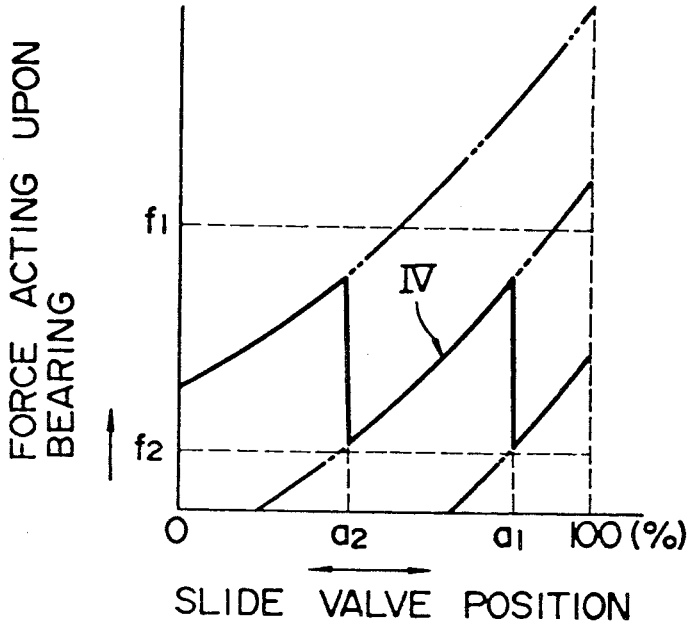
FIG. 5 is a graph illustrating a relationship between a slide valve position and a force acting upon a bearing in the screw compressor shown in FIG. 4.

When a slide valve 12 is positioned between its full load position and a preset position $a_1$ as seen from a solid line curve IV in FIG. 5, both of the opening/closing valves 10 and 10a are opened; when the slide valve 12 is positioned between the preset position $a_1$ and another preset $a_2$, either one of the opening/closing valves 10 and 10a, for example, the opening/closing valve 10a, is closed while the other opening/closing valve 10 is opened; and when the slide valve 12 is positioned on the no load side with respect to the preset position $a_2$, both of the opening/closing valves 10 and 10a are closed. Thus, as the slide valve 12 approaches the no load position from the full load position, the force acting in a direction from the sucking side to the discharging side is reduced stepwise. As a result, the force acting upon the bearing 4b is kept between the values $f_1$ and $f_2$ similarly as in the screw compressor shown in FIGS. 1 and 2.

Having now fully described the invention, it will be apparent to one of ordinary skill in the art that many changes and modifications can be made thereto without departing from the spirit and scope of the invention as set forth herein.

What is claimed is:

1. An oil-flooded screw compressor, comprising:

a housing;

a pair of meshing screw rotors accommodated for individual rotation in said housing;

a balance piston mounted for axial movement in parallel to axes of said screw rotors for causing, when operated, a force to act upon one of said screw rotors in a direction from the suction side to the discharge side;

a slide valve for adjusting the volume of said screw compressor;

flow path means for supplying a pressure fluid to said balance piston for operating said balance piston;

means for detecting a position of said slide valve in the axial direction;

control means for opening said flow path when said slide valve is positioned on a full load side with respect to a preset position, and for closing said flow path when said slide valve is positioned at any other positions;

a second balance piston mounted for axial movement in parallel to the axes of said screw rotors for causing, when operated, a force to act upon the other screw rotor in the direction from the sucking side to the discharge side; and second flow path means for supplying a pressure fluid to said second balance piston for operating said second balance piston, said control means controlling the first and second flow paths to be selectively opened or closed in response to two different positions of said slide valve detected by said detecting means.

2. An oil-flooded screw compressor, comprising:

a housing, a pair of meshing screw rotors accommodated for individual rotation in said housing, a balance piston mounted for axial movement in parallel to axes of said screw rotors for causing, when operated, a force to act upon one of said screw rotors in a direction from the suction side to the discharge side, a slide valve for adjusting the volume of said screw compressor, flow path means for supplying a pressure fluid to said balance piston for operating said balance piston, means for detecting a position of said slide valve in the axial direction, and control means including a two position valve for opening said flow path when said slide valve is positioned on a full load side with respect to a preset position, and for closing said flow path when said slide valve is positioned at any other position.

3. An oil-flooded screw compressor according to claim 1, wherein said two position valve comprises an electromagnetic opening/closing valve capable of opening or closing said flow path, and wherein said control means further comprises means for developing, in response to a position of said slide valve detected by said detecting means, an instruction signal to instruct said electromagnetic opening/closing valve to open or close said flow path.

4. An oil-flooded screw compressor according to claim 2, wherein said detecting means includes a motion converting mechanism for converting an axial movement of said slide valve into a rotational movement of a rotatable member, and means for detecting an angular position of said rotatable member.

5. An oil-flooded screw compressor according to claim 4, wherein said rotatable member is a shaft received for axial movement in a hollow center bore formed in another shaft to which said slide valve is secured, said rotatable member having a helical groove formed on an outer periphery thereof while a pin is fixed to said shaft of said slide valve and engaged for sliding movement in said helical groove of said rotatable member so that said rotatable member is rotated upon axial movement of said slide valve.

* * * * *